US005230376A

United States Patent [19]

Woodruff et al.

[11] Patent Number: 5,230,376

[45] Date of Patent: Jul. 27, 1993

[54] DOOR WITH TRANSOM WINDOW

[75] Inventors: Alan H. Woodruff, Altoona; Robert C. Tweedt, Ankeny, both of Iowa

[73] Assignee: Emco Enterprises, Inc., d/b/a Emco Specialties, Inc., Des Moines, Iowa

[21] Appl. No.: 861,576

[22] Filed: Apr. 1, 1992

[51] Int. Cl.[5] ..... E06B 3/32

[52] U.S. Cl. ..... 160/90; 160/231.2

[58] Field of Search ..... 52/455, 456; 160/90, 160/92, 113, 180, 181, 182, 218, 231.1, 231.2, 229.1, 369, 371, 377, 91; 49/163, 169, 381, 394

[56] References Cited

U.S. PATENT DOCUMENTS

| | | | |
|---|---|---|---|
| 1,033,582 | 7/1912 | Harris | 49/169 X |
| 1,273,520 | 7/1918 | Millsaps | 160/91 |
| 2,256,854 | 9/1941 | Scott | 49/163 X |
| 2,507,965 | 5/1950 | Eichner | 160/231.2 X |
| 2,568,130 | 9/1951 | Olson | 49/163 X |
| 2,611,933 | 9/1952 | Comfort | 49/169 X |
| 2,765,031 | 10/1956 | Landry | 160/182 X |
| 2,884,051 | 4/1959 | Hollingsworth | 160/92 |
| 2,980,181 | 4/1961 | Greenstein et al. | 160/91 |
| 3,226,776 | 1/1966 | Wormer | 49/169 X |
| 3,592,289 | 7/1971 | Aysta et al. | 160/231.2 X |
| 3,704,563 | 12/1972 | Waller | 160/369 X |
| 4,271,892 | 6/1981 | Brusseau et al. | 160/92 |
| 4,761,916 | 8/1988 | Sanok et al. | 160/231.2 X |

*Primary Examiner*—David M. Purol

*Attorney, Agent, or Firm*—Zarley, McKee, Thomte, Voorhees, & Sease

[57] ABSTRACT

A door with transom window includes a window opening in which are placed an upper transom window and a lower stationary window. The lower edge of the transom window is adjacent and hinged to the upper edge of the stationary window so that the transom window is pivotal from a closed position, wherein both the transom window and the stationary window completely fill the window opening to an open position, wherein the transom window is in facing engagement with the stationary window and the upper portion of the window opening is opened. Securing tabs detachably engage the transom window in its open position.

17 Claims, 3 Drawing Sheets

DOOR WITH TRANSOM WINDOW

BACKGROUND OF THE INVENTION

This invention relates to a door with a transom window. Exterior doors often are provided with windows which may be opened to permit fresh air to enter the interior of the building. However, most of the windows in these doors open from the bottom rather than from the top. This is particularly true in storm doors.

Therefore, a primary object of the present invention is the provision of an improved door having a transom window.

A further object of the present invention is the provision of an improved door having a transom window which can be opened at the top, rather than at the bottom as in prior devices.

A further object of the present invention is the provision of a window assembly which includes a transom window capable of opening a portion of the window and which also permits removal of the entire window assembly to open the entire window.

A further object of the present invention is the provision of an improved door having a transom window which is hinged at its lower edge.

A further object of the present invention is the provision of an improved door with transom window which can be opened and fastened in its open position so as to withstand movement of the door during opening and closing.

A further object of the present invention is the provision of an improved door with transom window which utilizes a flexible hinge for hinging the transom window.

A further object of the present invention is the provision of an improved door having a transom window which is economical to manufacture, durable in use, and efficient in operation.

SUMMARY OF THE INVENTION

The door with transom window of the present invention includes a window opening therein. Fitted within the window opening is a window assembly having an upper transom window and a lower stationary window. The stationary window is secured within the lower portion of the window opening, thereby leaving a transom opening at the upper end of the window opening. The transom window is hinged to the upper edge of the stationary window and is pivotal to a closed position covering the transom opening, and is movable from that position to an open position wherein it folds downwardly into facing engagement with the stationary window. When the transom window is closed, the transom window and the stationary window combine to completely fill the window opening. When the transom window is open, the transom opening at the top of the window opening is open to permit air to pass through the transom opening.

The hinge between the transom window and the stationary window is a flexible hinge. It is formed by an elongated plastic, flexible material having upper and lower edges. The upper edge includes a T-shaped flange which is fitted within a channel at the bottom edge of the transom window. The lower edge of the hinge also has a T-shaped flange which is fitted within a corresponding channel in the upper edge of the stationary window. When the two windows pivot with respect to one another, the flexible hinge folds along its longitudinal length to permit the hinged movement between the two windows.

A pair of clips are operatively attached to the opposite side edges of the stationary window. These clips include tabs thereon which are adapted to retentively engage the transom window when it is folded to its open position. These tabe hold the transom window against movement during opening and closing of the door.

DESCRIPTION OF THE PREFERRED EMBODIMENT

Figure 1:
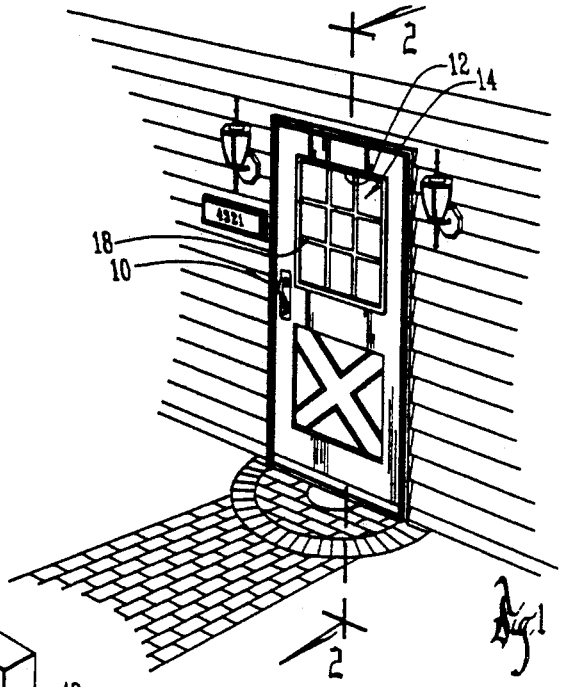
FIG. 1 is a perspective view showing the door of the present invention installed on an exterior wall of a building.
Figure 2:
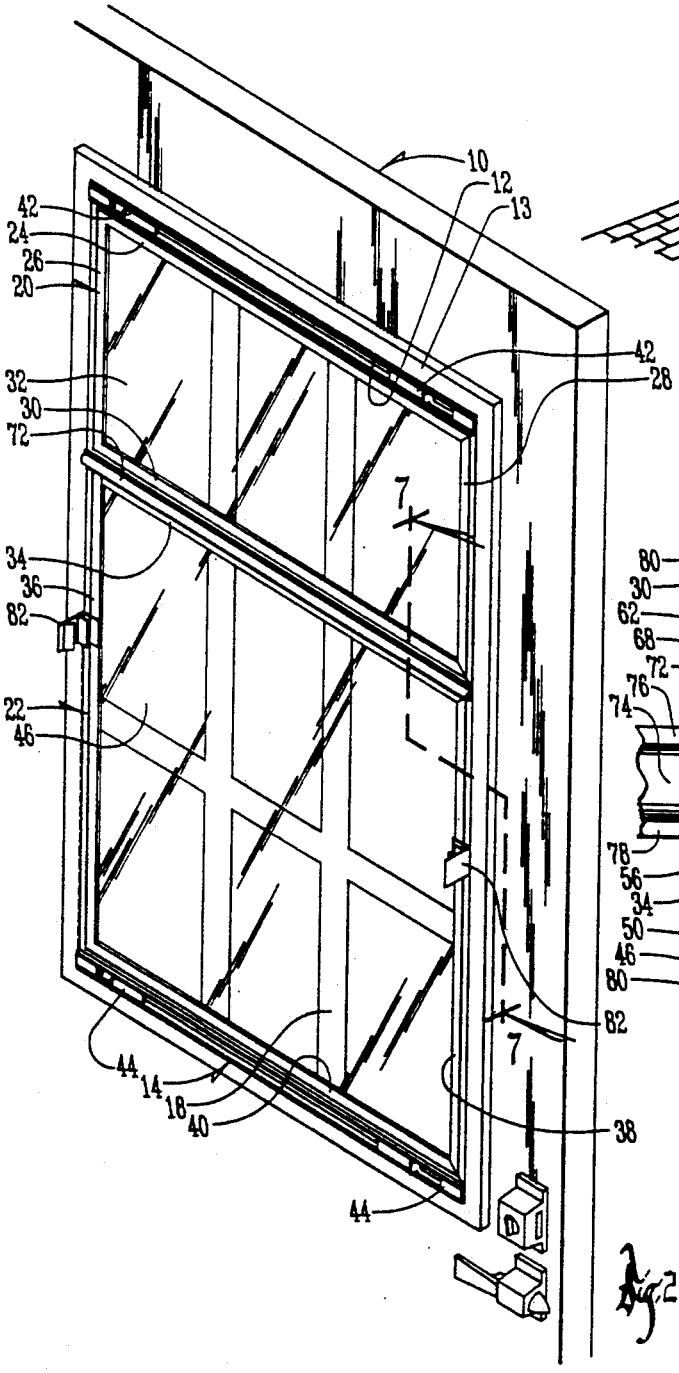
FIG. 2 is a partial perspective view of the door as viewed from the inside of the door.
Figure 9:
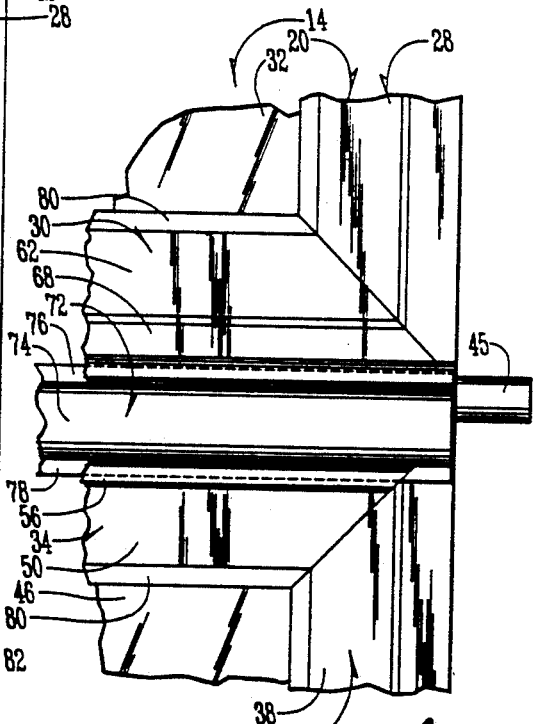
FIG. 9 is a front elevational view taken along line 9—9 of FIG. 7.

Referring to drawings, the numeral 10 generally designates the door of the present invention. Door 10 includes a rectangular window opening 12 having a screen 16 (FIGS. 7 and 8) fitted over the exterior thereof. Fitted over screen 16 is a decorative mullion frame 18. Extending around the perimeter of window opening 12 is a rectangular retainer frame 13.

Fitted within the window opening 12 are an upper transom window 20 and a lower stationary window 22. Transom window 20 covers a transom window opening 21 (FIG. 3) which comprises an upper portion of the window opening 12. Transom window 20 is surrounded by a top frame 24, side frames 26, 28, and bottom frame 30. These frames surround a glass pane 32. Stationary window 22 is surrounded by a top frame 34, side frames 36, 38, and bottom frame 40. The two windows are fitted together in edge to edge relationship with the bottom frame 30 of transom window 20 being adjacent the top frame 34 of the stationary window 22. At the upper corners of transom window 20 are a pair of bayonet latches 42 which detachably secure the upper corners of the window assembly 14 to the door in conventional fashion. The lower corners of stationary window 22 are secured to the door by similar bayonet latches 44. The upper corners of the stationary window 22 include retaining pins 45 which are fitted within corresponding slots (not shown) in the margin of the window opening in conventional fashion. Pins 45 and bayonet latches 44 secure stationary window 22 within the window opening 12 in a stationary mode whereby the window is not slidable or hinged in any manner. The stationary window 22 is removable by releasing bayonet latches 44 and removing pins 45 from the grooves in the margins of the window opening 12.

Stationary window 22 includes a glass pane 46 which is surrounded by the top frame 34, side frames 36, 38, and bottom frame 40.

Figures 6, 7, 8:
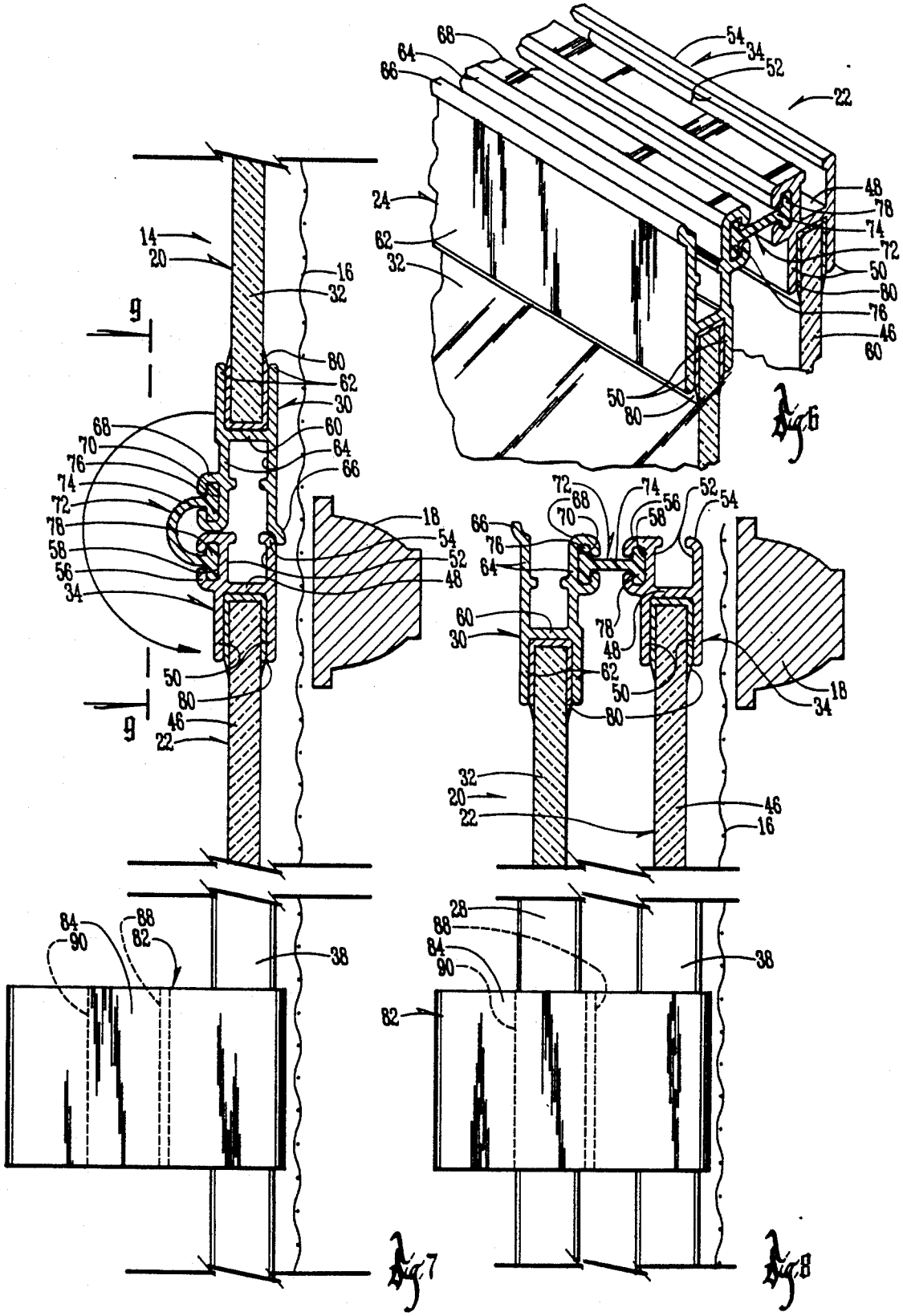
FIG. 6 is a detailed perspective view showing the transom window in section in its open position.
FIG. 7 is a sectional view taken along line 7—7 of FIG. 2.
FIG. 8 is a sectional view similar to FIG. 7, but showing the transom window in its open position.

FIGS. 6–8 show the cross-sectional configuration of the bottom frame 30 of transom window 20 and the top frame 34 of stationary window 22. Top frame 34 of stationary window 22 includes in cross-section a web 48 and a pair of spaced apart glass receiving flanges 50 which embrace the opposite sides of glass pane 46. Eastomeric glass seals 80 surround the edges of glass pane 46 and are fitted between the glass pane 46 and the glass receiving flanges 50 of top frame 34. Top frame 34 also includes a pair of spaced apart open flanges 52, one of which includes an inwardly curled flange 54. The other open flange 52 includes on its outer surface a pair of spaced apart C-flanges 56 which form a C-shaped channel 58 therebetween.

The bottom frame member 30 of transom window 20 includes a web 60, a pair of glass receiving flanges 62, and a pair of oppositely spaced open flanges 64. One of the flanges 64 includes a curled flange 66 which as can be seen in FIG. 7 is shaped to matingly fit with the inwardly curled flange 54 of top frame 34 of the stationary window 22. Extending from the inwardly facing surface of the other open flange 64 are a pair of C-flanges 68 which form a channel 70 therebetween. The above described cross-sectional configurations for bottom frame 30 of window 20 and for top frame 34 of stationary window 22 are generally H-shaped in configuration.

Transom window 20 and stationary window 22 are joined together by a flexible hinge 72 which is formed of flexible plastic, rubber, or other flexible material. The preferred material for hinge 72 is an extruded polypropylene material manufactured by Quantum Chemical Corp., having an address of 11500 N. Lake Drive, Cincinnati, Ohio 45249, under the trade designation PP-150-1130. Other types of flexible material will also work satisfactorily.

Hinge 72 includes a central web 74, a first T-shaped edge flange 76, and a second T-shaped edge flange 78. The first T-shaped flange 76 is slidably inserted into the C-shaped channel 70 of bottom frame 30 of transom window 20. Similarly, the second T-shaped flange 78 is fitted within the C-shaped channel 58 of top frame member 34 of stationary door 22. The flexible nature of the central web 74 of hinge 72 permits the transom window 20 to pivot from its closed position shown in FIG. 7 to its open position shown in FIG. 8. As can be seen from FIGS. 7 and 8, the web 74 flexes into an arcuate shaped when the transom window 20 is in its closed position, and assumes the cross bar of an H-shaped form when the transom window 20 is in its open position shown in FIG. 8.

Figures 3, 4, 5:
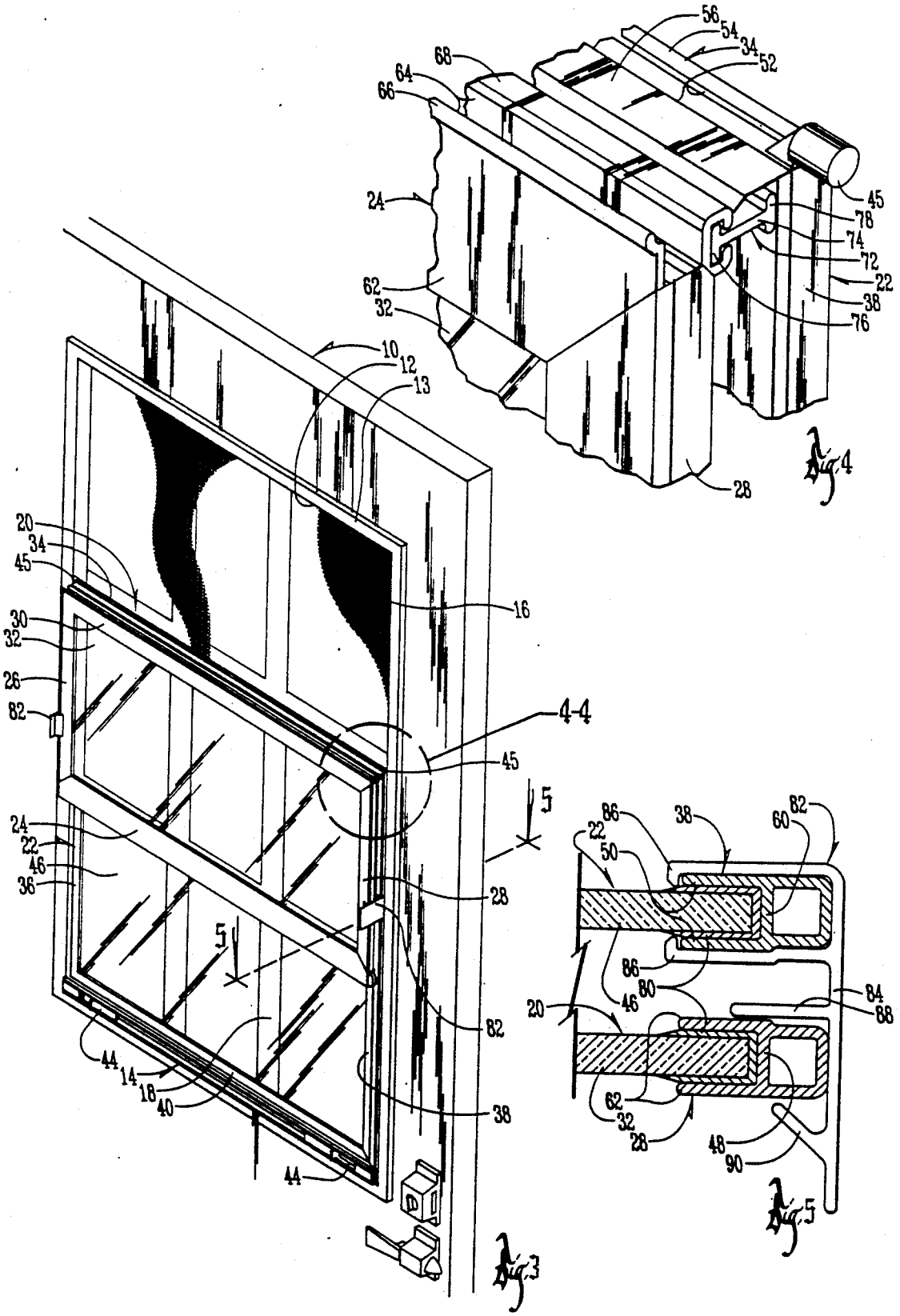
FIG. 3 is a view similar to FIG. 2, but showing the transom window in its open position.
FIG. 4 is an enlarged perspective view of the hinged transom and stationary windows as viewed along line 4—4 of FIG. 3.
FIG. 5 is a sectional view taken along line 5—5 of FIG. 3.

A pair of securing brackets or tabs 82 are secured to the opposite side edges of the stationary window 22 and are adapted to retentively engage the opposite side edges of the transom window 20 when the transom window 20 is in its open position (FIG. 3). Securing tab 82 includes an elongated side leg 84 having at one end thereof a pair of spaced apart parallel flanges 86, and also having a pair of spaced apart flanges 88, 90. Flange 90 is angled with respect to flange 88 and is flexible so that it will deflect when engaged by the side frames 28 of transom window 20. As can be seen in FIG. 5, the spaced apart flanges 86 are snapped over the side frame member 38 of stationary window 22. When the transom window 20 is folded to its open position as shown in FIG. 3, the side frame members 28 of transom window 20 engage flexible angled flange 90 and deflect angle flange 90 so that they can pass by the flange 90 into engagement with the first flange 88 which is more rigid than the flange 90. Due to the angular disposition of flange 90, once the transom window 20 is snapped into position between the flanges 88, 90, it is retentively held in that position so that when the door 10 is opened and closed, the open transom window 20 will be held against movement relative to the door 10. When it is desired to close the transom window 20, side legs 84 can be manually deflected outwardly away from transcom window 20 by a person's thumbs until side frames 28 of transom window 20 will clear flanges 90 to permit transom window 20 to return to its closed position.

The present invention permits the opening of the window at the top rather than at the bottom as with most conventional sliding door frame windows. Furthermore, because the windows 20, 22 are hinged with respect to one another, they do not require a double track groove in the margins of the window opening as is the case with many prior art windows. Thus, the present invention provides a simpler construction than prior devices.

Another advantage obtained from the present invention is the ease with which the entire window assembly 14 can be removed. Transom window 20 can be folded to its open position to open a portion of the window opening 12. However, if it is desired to open the entire window opening 12, the window assembly 14 can be removed entirely by releasing lower bayonet latches 44 and disengaging retaining pins 45 to permit complete removal of window assembly 14. Such removal is also made easier when transom window 20 is in its open position shown in FIG. 3 with its edges being held by securing tabs 82.

The flexible hinge 72 provides two important functions. First, it provides a hinged connection between transom window 20 and stationary window 22. Second, web 74 of hinge 72 provides a sealing closure between windows 20, 22 so as to minimize the leakage of air therebetween.

The preferred embodiment of the invention has been set forth in the drawings and specification, and although specific terms are employed, these are used in a generic or descriptive sense only and are not used for purposes of limitation. Changes in the form and proportion of parts as well as in the substitution of equivalents are contemplated as circumstances may suggest or render expedient without departing from the spirit or scope of the invention as further defined in the following claims.

We claim:

1. In combination:

a door having a window opening therein, said window opening having a top edge, a bottom edge, a hinge edge, and a latch edge, a window assembly including first and second windows, each having top and bottom edges;

elongated hinge means pivotally interconnecting said top and bottom edges of said first and second windows for hinged movement with respect to one another about a hinge axis, said hinge means extending substantially along the entire lengths of said top and bottom edges of said first and second windows;

first securing means releasably securing said first window to said door in covering relation over a first portion of said window opening;

second securing means releasably securing said second window to said door in a closed position in covering relation over a second portion of said window opening, wherein said first and second windows completely fill said window opening;

said second securing means being releasable to permit said second window to swing about said hinge axis from said closed position to an open position leaving said second portion of said window opening unfilled by said window assembly;

third securing means engageable with said second window when said second window is in said open position to releasably hold said second window in said open position;

said first and second windows being in face to face relation to one another when said second window is in said open position and being in edge to edge contact with one another when said second window is in said closed position.

2. A combination according to claim 1 wherein said top edge of said first window and said bottom edge of said second window are connected to said hinge means, said first and second securing means being releasable at the same time to permit removal of said first window, said second window, and said hinge means as a single unit from said window opening.

3. A combination according to claim 2 wherein said top edge of said second window is above said hinge means and adjacent said top edge of said window opening when said second window is in said closed position, said top edge of said second window being below said hinge means when said second window is in said open position.

4. A combination according to claim 1 wherein said hinge means is a flexible hinge.

5. A combination according to claim 4 wherein said first and second windows each comprise frame means extending around the perimeter thereof, said flexible hinge comprising a flexible member operatively secured to said frame means of said first window and said frame means of said second window, said flexible member being foldable along said hinge axis during movement of said second window between said open and said closed positions.

6. A combination according to claim 5 wherein said frame means of said first and second windows each include an elongated channel having a longitudinal axis extending parallel to said hinge axis, said flexible member having a first elongated edge retentively engaged by said channel of said first window and a second edge retentively engaged by said channel of said second window.

7. A combination according to claim 6 wherein said flexible member comprises in cross-section first and second edge flanges at said first and second edges thereof and a central web extending between said first and second edge flanges, whereby said first and second edge flanges and said central web create an H-shaped cross-sectional configuration.

8. A combination according to claim 1 wherein said first and second windows each comprise opposite side edges extending between said top and bottom edges thereof, said third securing means comprising at least one securing tab operatively attached to one of said side and bottom edges of said first window.

9. A combination according to claim 8 wherein said one securing tab comprises a flexible securing flange adapted to retentively detachably engage one of said top and side edges of said second window when said second window is in said open position.

10. In combination:

a door having a rectangular window opening therein, said window opening having a top edge, a bottom edge, a hinge edge, and a latch edge;

a rectangular window assembly including a first window, a second window, and hinge means interconnecting said first and second windows for pivotal movement therebetween about a hinge axis from a first position wherein said first and second windows are in edge to edge relation in approximately the same plane to a second position wherein said first and second windows are in face to face relation with one another;

said rectangular window assembly having a rectangular perimeter formed by portions of both of said first and second windows;

said window assembly being matingly fitted within and closing said window opening with said rectangular perimeter engaging said top edge, said bottom edge, said hinge edge, and said latch edge of said window opening when said first and second windows are in said first position;

first securing means detachably securing said first window to said door within said window opening;

second securing means detachably securing said second window to said door within said window opening;

said first and second securing means being separately detachable to permit said entire window assembly to be removed from said window opening when both of said securing means are detached and to permit one of said first and second windows to be pivoted about said hinge axis to said second position when only one of said first and second securing means is detached and the other of said first and second securing means holds said window assembly within said window opening.

11. A combination according to claim 10 wherein said hinge axis is horizontal when said window assembly is within said window opening, and said one window is above said other window when said windows are in said first position.

12. A combination according to claim 10 wherein said first and second windows each have a hinge edge attached to said hinge means, said hinge edges being in edge to edge contact with one another when said first and second windows are in said first position.

13. In combination:

a door having a window opening therein, said window opening having a top edge, a bottom edge, a hinge edge, and a latch edge, a window assembly including first and second windows, each having top and bottom edges;

hinge means pivotally interconnecting said first and second windows for hinged movement with respect to one another about a hinge axis;

first securing means operatively securing said first window to said door in covering relation over a first portion of said window opening;

second securing means releasably securing said second window to said door in a closed position in covering relation over a second portion of said window opening, wherein said first and second windows completely fill said window opening;

said second securing means being releasable to permit said second window to swing about said hinge axis from said closed position to an open position leaving said second portion of said window opening unfilled by said window assembly;

third securing means engageable with said second window when said second window is in said open position to releasably hold said second window in said open position;

said first and second windows being in face to face relation to one another when said second window is in said open position and being in edge to edge relation to one another when said second window is in said closed position;

said first and second windows each comprising frame means extending around the perimeter thereof;

said hinge comprising an elongated flexible member having an H-shaped cross sectional shape formed by first and second edge flanges interconnected by a control web, said first and second edge flanges being operatively connected to said frame means of said first and second windows, respectively, said web portion being foldable along said hinge axis during movement of said second window between said open and closed positions.

14. A combination according to claim 13 wherein said first and second edge flanges of said elongated flexible member are detachably secured to said frame means of said first and second windows, respectively.

15. A combination according to claim 13 wherein said frame means of said first and second windows each include an elongated channel having a longitudinal axis extending parallel to said hinge axis, said channels of said first and second windows detachably retentively, of said elongated flexible second edges flanges, respectively, of said elongated flexible member.

16. A combination according to claim 15 wherein said first edge flange retentively fits within said channel to said frame means of said first window and said second edge retentively fits within said channel of said frame means of said second window.

17. A combination according to claim 16 wherein said control web extends between and forms a closure between said top edge of said first window and said bottom edge of said second window.

* * * * *